United States Patent [19]

Melander

[11] 4,213,219

[45] Jul. 22, 1980

[54] TENSIONING DEVICE FOR AN INFLATABLE STRUCTURE

[75] Inventor: Clarence Melander, Newark, Del.

[73] Assignee: East Wind Industries, Inc., Dover, Del.

[21] Appl. No.: 920,866

[22] Filed: Jun. 30, 1978

[51] Int. Cl.[2] ..... B63C 9/02

[52] U.S. Cl. ..... 9/4 R; 9/11 A; 9/2 A

[58] Field of Search ..... 9/2 R, 2 A, 11 R, 11 A, 9/1.5, 6 R, 13, 14, 310 H; 244/125, 126, 219

[56] References Cited

U.S. PATENT DOCUMENTS

| | | | |
|---|---|---|---|
| 1,130,480 | 3/1915 | Czarnik | 9/2 A |
| 1,349,897 | 8/1920 | McDonah | 9/11 R |
| 1,364,596 | 1/1921 | Wales | 244/125 |
| 1,456,168 | 5/1923 | Witmer | 9/11 A |
| 2,933,739 | 4/1960 | Miller | 9/11 A |
| 2,970,324 | 2/1961 | Phillips | 9/11 A |

FOREIGN PATENT DOCUMENTS

| | | | |
|---|---|---|---|
| 114897 | 5/1941 | Australia | 9/2 A |

*Primary Examiner*—Trygve M. Blix
*Assistant Examiner*—D. W. Keen
*Attorney, Agent, or Firm*—John J. Kane; Frederick A. Zoda; Albert Sperry

[57] ABSTRACT

A tensioning device for an inflatable structure which includes a deck area to provide a floor for the inflatable structure, an outer inflatable member providing the main flotation for the deck, the outer inflatable member extending around the outer periphery of the deck, and an inner inflatable member which is integrally connected to the deck to provide additional buoyancy to the central area of the deck but primarily to increase the tensioning of the deck of the inflatable structure since a portion of the material of the deck comprises a portion of the walls of the inflatable chamber of the inner inflatable member and as such inflation of the toroidal inner inflatable member causes the lower wall section thereof which itself is a portion of the deck itself to assume a downwardly facing convex arcuate configuration which increases the tension on the deck between the inner and outer inflatable members, the device may alternatively include valves for controlling the buoyancy and tensioning as well as a canopy and a central mast for holding the canopy suspended above the deck, the inner inflatable member preferably comprising a lower wall section which is formed by a portion of the deck area and an upper wall section which is peripherally secured to the lower wall section by connecting tape which is located about the periphery thereof to hermetically seal the inflation chamber of the inner inflatable member to provide the manner of increasing the buoyancy and tensioning of the deck.

10 Claims, 6 Drawing Figures

Fig. 1
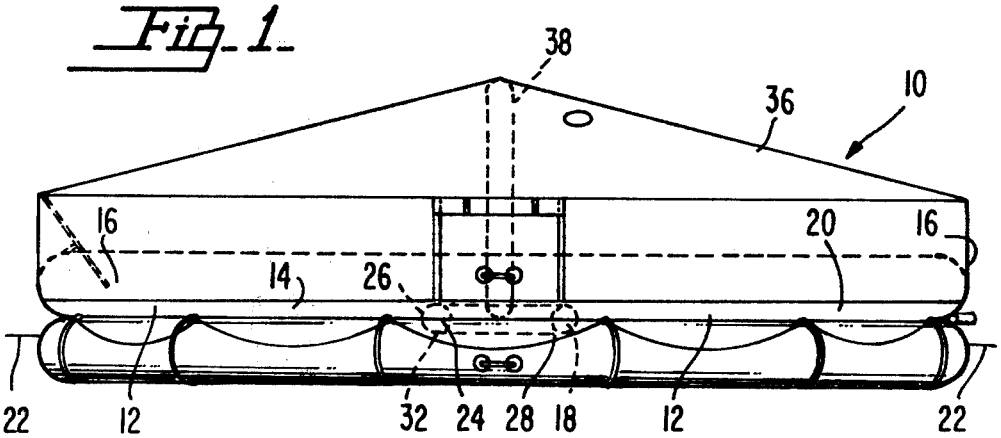
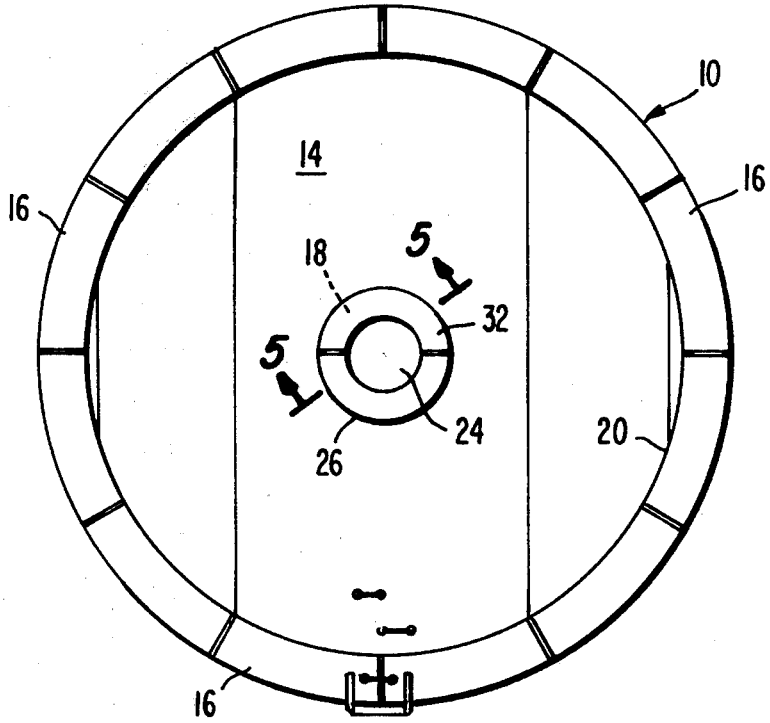
Fig. 2

TENSIONING DEVICE FOR AN INFLATABLE STRUCTURE

BACKGROUND OF THE INVENTION

1. Field of the Invention

The present invention pertains generally to the field of inflatable structures which are designed to provide buoyancy when located in water environments such as the high seas, rivers, lakes and the like.

A common problem with such inflation devices is the lack of tension existing within the floor area or deck thereof. The present invention provides a novel means for increasing the tension or supporting characteristics of the floor area of such an inflatable structure which is created simultaneously with the inflation of the device itself.

Generally a main flotation member is peripherally located about the outer edge of the deck area. Sometimes an additional flotation member such as an inner flotation member is utilized in the central area to provide an additional amount of buoyancy in the central area of the deck which is furthermost from the buoyancy supplied by the outer flotation device. The present invention provides a means for utilizing this central buoyancy device in a novel manner to simultaneously increase the tension on the deck area.

2. Description of the Prior Art

A great number of patents exist within the field of such inflatable devices and three examples of such patents are: U.S. Pat. Nos. 1,349,897; 1,456,168; and 2,933,739. None of these patents show or suggest the use of a toroidal center section. Also none of the patents specifically deal with the use of a portion of the deck area to comprise directly one of the walls of an essentially located inflatable member.

Many devices include inflatable centrally located inflatable members however these devices have heretofore been configured having their own wall configurations separately and distinct from the deck area itself and as such inflation thereof does not increase the tension in the deck area. In this regard the present invention distinguishes over the above patents and all other such prior art.

SUMMARY OF THE INVENTION

The present invention provides a device for tensioning of the deck of an inflatable structure in order to increase the buoyancy thereof and maintain the deck in a more accurate horizontal orientation. The present invention includes a deck which is adapted to extend horizontally and provide a floor surface upon inflation of the inflatable structure. The deck is maintained horizontally by the inflation of an outer inflatable member which is secured around the periphery of the deck to support the outer edges thereof upon the surface of the water. The present invention also includes an inner inflatable member which is integrally connected to the deck means to provide an additional means of buoyancy to the central area of the deck means.

One of the novel characteristics of the present invention is in the forming of the walls of the inner inflatable member to include as one wall thereof a portion of the material of the deck means itself to thereby provide a means for tensioning the deck area upon inflation of the inner inflatable member.

The inner inflatable member is preferably in the shape of a toroid which is adapted to decrease in overall lateral diameter upon inflation of the toroid to thereby apply increased lateral force or tension to the deck. This toroidal inner inflatable member is formed of three main parts including an upper wall section and a lower wall section and a connecting tape therebetween. The lower wall section is the portion which is formed by a section of the deck means itself. The upper and lower wall sections are connected together by a connecting tape which is located about the periphery of the upper and lower wall sections to join them together to define a hermetically sealed chamber which thereby provides the inner inflatable member.

Upon inflation of the inner inflatable member the lower wall section assumes a downwardly facing concave arcuate configuration due to the generally round configuration which the chamber of the inner inflatable member assumes upon inflation thereof.

The present invention may also include an inflatable or non-inflatable central mast means which is adapted to the position in the approximate center area of the deck to hold a canopy means extending laterally above at least a portion of the deck area.

It is an object of the present invention to provide a tensioning device for an inflatable structure for holding the floor area thereof in a tightly tensioned horizontal orientation.

It is an object of the present invention to provide a tensioning device for an inflatable structure which is formed integrally by a central buoyancy member.

It is an object of the present invention to provide an inflatable structure which includes a tensioning device which is formed by the choosing of a wall of a centrally located inflatable member to comprise a portion of the deck area and as such pull inwardly from an outer inflatable member upon inflation of the inner and outer inflatable members.

It is an object of the present invention to provide a tensioning device for an inflatable structure which is inexpensive to manufacture and efficient in operation.

It is an object of the present invention to provide a tensioning device for an inflatable structure which is easy to use and requires no additional operations other than merely the normal inflation of the inflatable areas of the inflatable structure.

It is an object of the present invention to provide a tensioning device for an inflatable structure which comprises a centrally located buoyancy member which is toroidal in overall shape.

It is an object of the present invention to provide a centrally located buoyancy device within the deck area of an inflatable structure which when inflated decreases in overall lateral diameter in order to tighten the deck area of the inflatable structure.

It is an object of the present invention to provide a valve means positioned within the walls of an inner inflatable member to facilitate accurate control of central buoyancy of the overall inflatable structure and accurate control of the tension in the deck area.

It is an object of the present invention to provide a tensioning device for an inflatable structure which is usable with a canopy means which can be held at an elevated position by a central mast means.

It is an object of the present invention to provide a tensioning device for an inflatable structure which causes tensioning due to the downwardly facing convex arcuate configuration of a wall of the deck area which comprises a wall of the inner inflatable member upon inflation thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a side view of an embodiment of the entire inflatable structure of the present invention;

FIG. 2 is a top plan view looking down upon an embodiment of the inflatable structure of the present invention wherein the canopy has been omitted to facilitate viewing thereof;

DETAILED DESCRIPTION OF THE PREFERRED EMBODIMENT

Figure 3:
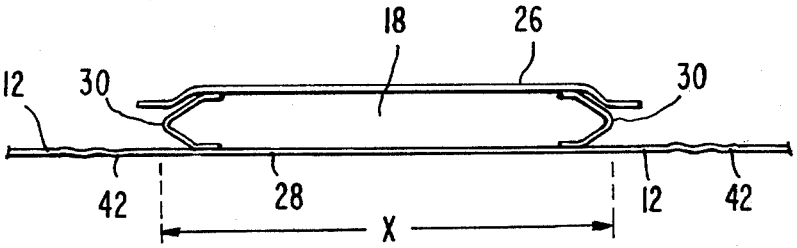
FIG. 3 is a side cross-sectional view of an embodiment of a tensioning device of the present invention shown in the deflated state.

The present invention provides a tensioning device for use in maintaining the deck of an inflatable structure in a taut condition. The inflatable structure 10 is shown in FIGS. 1 and 2 in side and plan view respectively. The overall structure 10 includes an outer inflatable member 16 which may be circular and a deck means 12 which covers the entire interior surface of the generally annular outer inflatable member 16. The deck means 12 provides a floor surface 14 to serve as the containment floor.

In order to maintain the interior or central deck area generally shown as 24 in a proper orientation it is often advisable to include an inner inflatable member 18 which may be of any general configuration however a toroidal member 32 has been found to be particularly usable with the present design. The inner inflatable member provides an additional amount of buoyancy near the center of the deck 12 where it is needed since the only other buoyancy is provided by the outer inflatable member 16 which is secured to the deck 12 only about the deck periphery 20. Since many rafts do sit low in the water that is in comparison to the water surface 22 especially when loaded it is definitely advantageous to include an inner inflatable member 18.

The present invention makes novel usage of this inner inflatable member 18 to provide a means for tensioning the deck 12 of the inflatable structure 10. To accomplish this purpose the inner inflatable member 18 is chosen in a toroidal configuration which through cross-section as shown best in FIGS. 3 through 6 includes an upper wall section 26 and the lower wall section 28 which are connected by connecting tape means 30. The upper wall section 26 will take the approximate form of an annular piece of flat material which is secured along the inner edge and along the outer periphery to the deck itself which comprises a lower wall section 28. The upper and lower wall sections are connected by a connecting means 30 which may be of a tape-like configuration which extends about the inner and outer periphery thereof to make firm air-tight connection therebetween to form an air-tight chamber which therefore will function as the inner inflatable member 18. The lower wall section 28 is merely an annular portion of the deck area such that when the inner inflatable member is inflated the member 18 will assume a downwardly facing convex shape 40 which will pull the deck means 12 inwardly toward the center of the floor 14 hence tightening and tensioning the floor and providing a more stable support surface.

Figure 4:
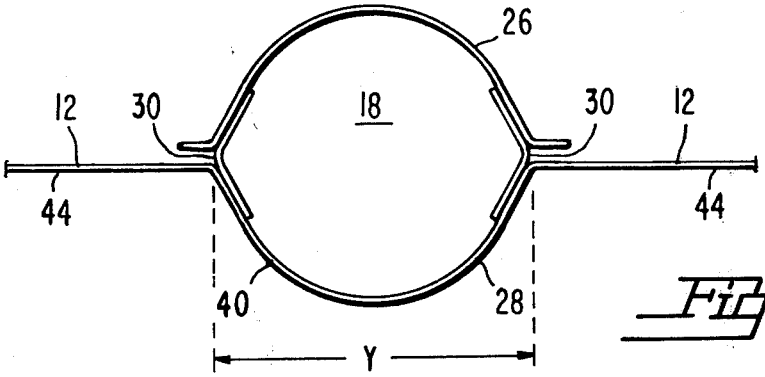
FIG. 4 is a side cross-sectional view of an embodiment of a tensioning device of the present invention shown in the inflated state.

Particularly the FIGS. 3 and 4 show that when the inner inflatable member 18 is inflated the generally v-shaped connecting tape means 30 will stand upwardly and downwardly and the assumption of a downwardly facing concave shape by the lower wall section will cause a decrease in the dimension from the deflated toroidal cross-sectional diameter X to the inflated toroidal cross-sectional diameter Y. As shown in this configuration the dimension X is larger than the dimension Y as shown in FIG. 3 however in FIG. 4 after inflation the new configuration will have a narrower toroidal cross-sectional diameter Y.

Figure 5:
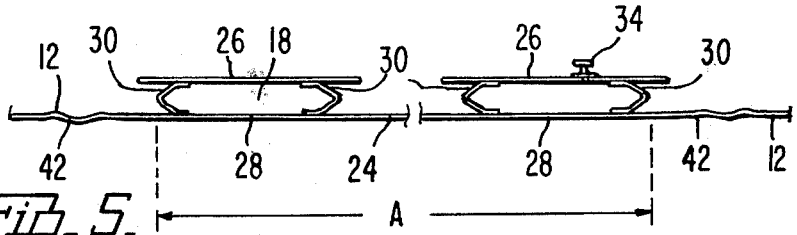
FIG. 5 is a side cross-sectional view of a preferred embodiment of a toroidal-shaped tensioning device of the present invention shown in the deflated state.
Figure 6:
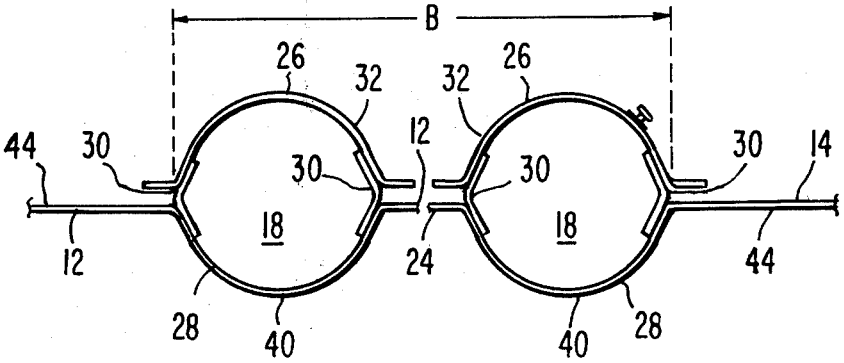
FIG. 6 is a side cross-sectional view of a preferred embodiment of a toroidal-shaped tensioning device of the present invention shown in the inflated state.

This same inner action is shown in FIGS. 5 and 6 for the overall lateral outer dimension of the toroid. When deflated this overall toroid dimension will be the dimension A whereas when inflated the dimension will be as shown to be dimension B. The dimension will decrease due to the non-linear orientation which the deck will assume upon inflation by the convexing of the lower wall section 28. In this manner as shown in FIGS. 5 and 6 the untensioned deck area 42 shown in FIG. 5 will be tightened or tensioned to provide the tensioned deck area 44 shown in FIG. 6. Generally, calculations have shown that dimension $B=0.637$ A with dimension A being deflated and dimension B being inflated. This pulling with certain sized inflatable structures 10 has shown to provide sufficient tensioning of the deck without providing undue stress and strain on the upper or lower wall sections or on the connecting tape means 30.

In order to facilitate inflation of the inner inflatable member 18 a valve means 34 may be included. In this manner very close control on the amount of inflation can be maintained in order to maintain the desired tensioning or central buoyancy.

In most embodiments a central mast means 38 will be included to hold a canopy means 36 above the overall deck 12. This configuration is shown in FIG. 1.

By making use of the deck itself to form a portion of the wall of the inner inflatable member 18 the present invention provides a combination of usages for this particular deck area such that inflation of the inner inflatable member 18 will not only provide the central buoyancy desired in such inflatable structures 10 but also will provide the tensioning means for the deck 12 which is very important especially in larger sized inflatable structures.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A tensioning device for an inflatable structure comprising:

(a) a deck means adapted to extend horizontally and provide a floor surface upon inflation of the inflatable structure;

(b) an outer inflatable member secured around the periphery of said deck means to support said deck means horizontally along the surface of the water upon inflation of said outer inflatable member; and (c) an inner inflatable member integrally connected to said deck means to provide additional buoyancy to the central area of said deck means, said inner inflatable member integrally including a portion of the material of said deck means as a portion of the walls of said member to cause tightening and tensioning of said deck means upon inflation of said inner inflatable member, said inner inflatable member comprising:

(1) an upper wall section;

(2) a lower wall section formed by a portion of said deck area; and (3) a continuous connecting means located around the periphery of said upper and lower wall sections to join each together for defining a hermetically sealed chamber to provide said inner inflatable member and to increase the central buoyancy and the tension applied to said deck means.

2. The device as defined in claim 1 wherein said inner inflatable member is toroidal in shape.

3. The device as defined in claim 2 wherein the overall lateral outer diameter of said toroidal inner inflatable member decreases upon inflation thereof.

4. The device as defined in claim 1 wherein said outer inflatable member is circular to be located annularly around the outer periphery of said deck means.

5. The device as defined in claim 1 further including a valve means defined in said inner inflatable member to inflate same and to control the amount of central buoyancy and deck tensioning.

6. The device as defined in claim 1 further including canopy means and a central mast means for holding said canopy means suspended above said deck means.

7. The device as defined in claim 1 wherein the portion of said deck means which forms section of the walls of said inner inflatable member assumes a downwardly facing convex arcuate configuration upon inflation of said inner inflatable member to increase the tension on said deck area between the inner and outer inflatable members.

8. The device as defined in claim 1 wherein said connecting means comprises a connecting tape means.

9. A tensioning device for an inflatable structure comprising:

(a) a deck means adapted to extend horizontally and provide a floor surface upon inflation of the inflatable structure;

(b) an outer annular inflatable member secured about the outer periphery of said deck means to support said deck means horizontally along the surface of the water upon inflation thereof;

(c) a toroidal inner inflatable member integrally connected to said deck means to provide additional buoyancy to the central area of said deck means, said inner inflatable member integrally including a portion of the material of said deck means as a portion of the walls of said member to cause tightening and tensioning of the deck means upon inflation of said inner inflatable member by decreasing the overall outer diameter of said toroidal inner inflatable member upon inflation thereof, said inner inflatable member further including:

(1) an upper wall section;

(2) a lower wall section formed by a portion of said deck area, said lower wall section forming a section of the walls of said inner inflatable member which section assumes a downwardly facing convex arcuate configuration upon inflation of said inner inflatable member to increase the tension on said deck area between said inner and outer inflatable members; and (3) a continuous connecting means located around the periphery of said upper and lower wall sections to join each together for defining a hermetically sealed chamber to provide said inflatable member and to increase the central buoyancy and the tension applied to said deck means; and (d) a valve means defined in said inner inflatable member to inflate same and to control the amount of central buoyancy and deck tensioning thereof.

10. The device as defined in claim 9 wherein said connecting means comprises a connecting tape means.

* * * * *